United States Patent [19]

Gomez

[11] 4,158,458

[45] Jun. 19, 1979

[54] TETHER BALL APPARATUS

[76] Inventor: Ismael M. Gomez, 477 Fuego St., Pomona, Calif. 91767

[21] Appl. No.: 796,979

[22] Filed: May 16, 1977

[51] Int. Cl.[2] ..... A63B 67/10

[52] U.S. Cl. ..... 273/95 A

[58] Field of Search ..... 273/95 A, 58 C, 26 E, 273/29 A, 184 B, 185 C, 185 D, 200 R

[56] References Cited

U.S. PATENT DOCUMENTS

| | | | |
|---|---|---|---|
| 2,606,025 | 8/1952 | Hornig | 273/58 C |
| 3,051,491 | 8/1962 | Cabot | 273/95 A X |
| 3,143,351 | 8/1964 | Bertrand | 273/200 R |
| 3,186,711 | 6/1965 | Morrow | 273/95 A UX |
| 3,288,413 | 11/1966 | Gregory | 273/95 A X |
| 3,498,613 | 3/1970 | Dreyer | 273/95 A |
| 3,588,104 | 6/1971 | Griffin | 273/26 E |
| 3,663,018 | 5/1972 | O'Leary | 273/26 A |
| 3,794,320 | 2/1974 | Salmont | 273/29 A |
| 3,804,409 | 4/1974 | Schachner | 273/95 A X |
| 3,829,093 | 8/1974 | Abrams | 273/95 A |
| 3,861,679 | 1/1975 | Culpepper | 273/26 E X |
| 3,893,669 | 7/1975 | Myers | 273/29 A |

FOREIGN PATENT DOCUMENTS

| | | | |
|---|---|---|---|
| 2351330 | 4/1975 | Fed. Rep. of Germany | 273/95 A |
| 1162827 | 4/1958 | France | 273/95 A |
| 838470 | 6/1960 | United Kingdom | 273/95 A |
| 1023771 | 3/1966 | United Kingdom | 273/95 A |

*Primary Examiner*—William H. Grieb

*Attorney, Agent, or Firm*—Christie, Parker & Hale

[57] ABSTRACT

A base is permanently anchored in a foundation in flush relationship therewith. The base includes threaded openings for receiving one or more threaded fasteners. A ball is attached to one end of a tether having an elastic portion and a nonelastic portion. An L-shaped support for the other end of the tether rotates with respect to a frame mounted on the base. The fasteners connect the frame to the base. The frame holds a vertical sleeve. The support has a vertical arm fitting within the sleeve and extending beyond one end thereof and a horizontal arm with a free end extending beyond the perimeter of the frame. A first projection extends radially outward from the vertical arm adjacent to the one end of the sleeve. A second projection extends axially from the one end of the sleeve to abut the first projection when predetermined limits of relative rotation between the sleeve and arm are reached.

7 Claims, 4 Drawing Figures

TETHER BALL APPARATUS

BACKGROUND OF THE INVENTION

This invention relates to recreational equipment and, more particularly, to improvements in tether ball apparatus.

Various forms of tether ball apparatus are well known in the art. A tether ball designed for kicking requires a strong anchor because of the violence of the force imparted to the ball. A rotatable tether support has been employed in the past to minimize torsional resistance and prevent winding of the tether around the support, and to increase the range of movement of the ball. One prior art system employs a tether comprising a nonelastic portion and an elastic portion to return the ball and absorb shock.

SUMMARY OF THE INVENTION

According to the invention, a L-shaped support has a vertical arm that is rotatably mounted on a base, and a horizontal arm that has a free end extending beyond the perimeter of the base. One end of a tether is attached to the ball, and the other end of the tether is attached to the free end of the horizontal arm. The tether is long enough to permit the ball to lie on the surface of the foundation on which the base lies. Preferably, the tether has an elastic portion and a nonelastic portion.

A feature of the invention is a simple and effective limit on the rotation of the tether support. A columnar member fits within a tubular member and extends beyond one end of the tubular member. One of the members comprises the vertical arm, and the other member is affixed to the base. A first projection extends radially outward from the columnar member adjacent to the one end of the tubular member, and a second projection extends axially from the one end of the tubular member to abut the first projection when predetermined limits of relative rotation between the members are reached.

Another feature of the invention is a base that is permanently anchored in the supporting structure in flush relationship therewith. The base includes threaded holes. A frame which supports the tether is mounted on the base to which it is connected by threaded fasteners engaging the threaded holes.

BRIEF DESCRIPTION OF THE DRAWING

The features of a specific embodiment of the best mode contemplated of carrying out the invention are illustrated in the drawing, in which.

DETAILED DESCRIPTION OF THE SPECIFIC EMBODIMENT

Figure 1:
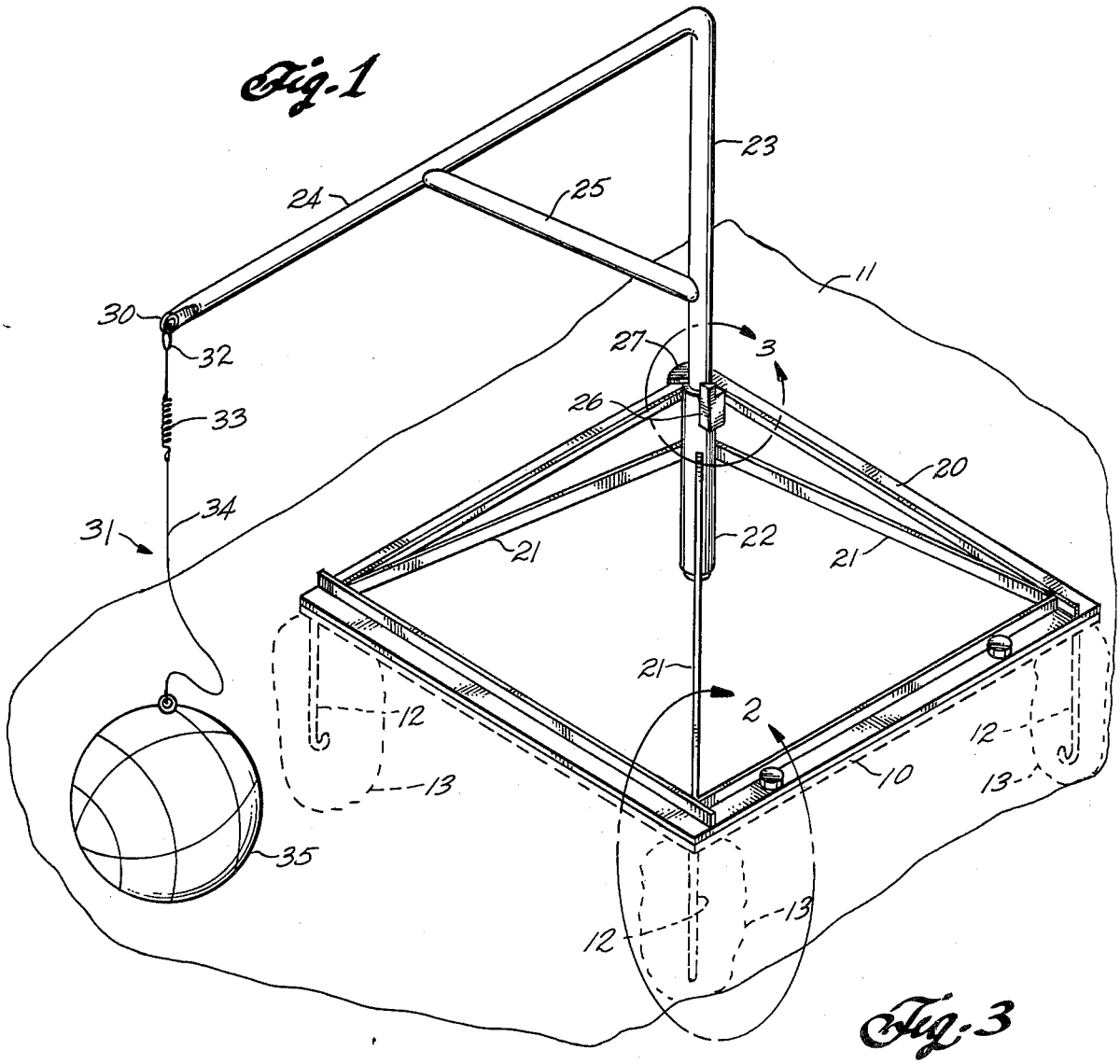
FIG. 1 is a perspective view of tether ball apparatus incorporating the features of the invention.
Figure 2:
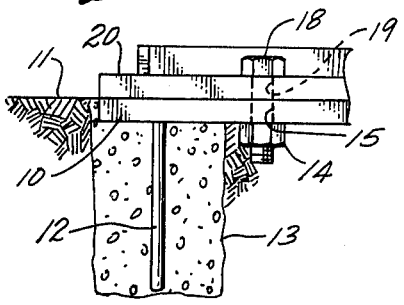
FIG. 2 is a side elevation view of a portion of the apparatus indicated in FIG. 1.

In FIG. 1 a square base 10 lies flush with the surface of a foundation 11, such as the ground or the floor of a building. Vertical anchoring pins 12 are attached to the corners of base 10, by means such as welding. Pins 12 are each cast in a concrete footing 13 to anchor base 10 in foundation 11. Base 10 has a plurality of threaded holes distributed around its perimeter. Specifically, as illustrated in FIG. 2, nuts 14 are welded to the underside of base 10 in alignment with unthreaded holes 15.

Figure 4:
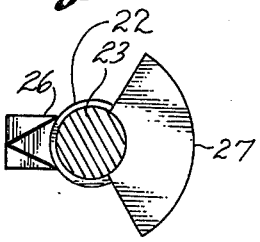
FIG. 4 is a top sectional view of a portion of the apparatus shown in FIG. 3.
Figure 3:
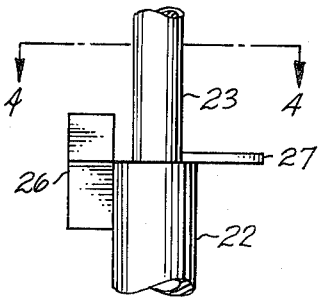
FIG. 3 is a side elevation view of another portion of the apparatus indicated in FIG. 1.

A square base 20 that is congruent with base 10, four beams 21 extending upwardly and inwardly from the corners of base 20, and a short vertical sleeve 22 at the junction of beams 21 are attached together by means such as welding, to form a unitary frame that is mounted on base 10. Threaded fasteners 18, which pass through openings 19 in base 20 aligned with openings 15 in base 10 (FIG. 2), are threaded into nuts 14 to connect bases 10 and 20. An L-shaped support has long arms 23 and 24 to which a strut 25 is attached by means such as welding. Arm 23, which serves as a columnar member, fits into sleeve 22, which serves as a tubular member, and extends beyond the top end of sleeve 22. Arm 23 is coaxial with and free to rotate within sleeve 22. An axially extending projection 26 is attached by means such as welding to the top end of sleeve 22. A radially extending projection 27 in the form of a flange segment is attached by means such as welding to arm 23 at a point between its ends. Projection 27 rests on the top end surface of sleeve 22, thereby serving as a vertical stop to limit the axial movement of arm 23 in sleeve 22. Projection 27 also serves as a stop to limit the rotation of arm 23 within sleeve 22, when it abuts projection 26. Thus, arm 23 is free to rotate within predetermined limits, preferably about 180°, set by the design of projections 26 and 27. The top of projection 26 preferably has triangular vertical side surfaces matching the vertical side surfaces of projection 27, as shown in FIG. 4.

The free end of arm 24, which is held in a horizontal position by arm 23 and sleeve 22, extends beyond the perimeter of base 20 as illustrated in FIG. 1, and has a ring 30 for attachment of a tether 31. Tether 31 comprises a snaffle hook 32 attached to ring 30, a spring 33 attached to one end to snaffle hook 32, a cord 34 attached at one end to the other end of spring 33 and at the other end to a ball 35. Spring 33 comprises an elastic portion, and cord 34 comprises a nonelastic portion of tether 31. Tether 31 is sufficiently long to permit ball 35 to lie on foundation 11.

As a result of the described structure, ball 35 can be kicked by the user of the apparatus from a position on the ground without interference from the tether support or frame. The rotation of arm 23 provides a greater distance of travel for a given tether length and absorbs the force applied to the ball. Spring 33 also serves to absorb the force applied to the ball and to return tether 31 to its initial position. The stops on the rotation of the tether support prevent repeated revolution of the ball and tether. During periods of nonuse, fasteners 18 can be unthreaded and the frame and tether support can be stored while base 10 remains out of the way in flush relationship with foundation 11.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention as defined in the following claims. For example, although a tether ball is shown, a soccer ball or football or other type of ball could be used with the apparatus of the invention, and force could be applied to the ball by other means such as with a bat or tennis raquet. In addition, balls of various weights can be used for training purposes so a user of the invention can build up his strength. Further, the various features of the invention could be practiced separately if desired. If a tennis ball or baseball is hit with a bat or racket, tether 31 could be suspended rather than on foundation 11.

What is claimed is:

1. Tether ball apparatus comprising:

a first horizontal rectangular base permanently anchored in a foundation;

a frame including a second horizontal rectangular base congruent with the first base, an L-shaped support having a vertical arm rotatably mounted on the frame and a horizontal arm having a free end extending beyond the perimeter of the bases, and a vertical sleeve into which the vertical arm rotatably fits;

means for limiting the rotation of the vertical arm within the sleeve;

means for fastening the second base to the first base;

a ball; and a tether having one end attached to the ball and the other end attached to the free end of the horizontal arm, the tether being long enough to permit the ball to lie on the foundation.

2. The apparatus of claim 1, in which the vertical arm extends beyond one end of the sleeve and the limiting means comprises a first projection extending radially outward from the vertical arm adjacent to the one end of the sleeve and a second projection extending axially from the one end of the sleeve to abut the first projection when predetermined limits of rotation of the vertical arm within the sleeve are reached.

3. The apparatus of claim 2, in which the one end of the sleeve is the top end and the first projection rests on the surface of the top end of the sleeve to limit the axial movement of the vertical arm in the sleeve.

4. The apparatus of claim 3, in which the tether has an elastic portion and a nonelastic portion.

5. The apparatus of claim 1, in which the first base is flush with the foundation.

6. The apparatus of claim 1, in which the first base comprises a plurality of aligned holes in the bases, a threaded fastener through each opening, and a nut threaded on each fastener.

7. The apparatus of claim 1, in which the frame further includes four upwardly and inwardly extending beams connected between the respective corners of the second base and the vertical sleeve.

* * * * *